US010767654B2

(12) United States Patent
Dittmar et al.

(10) Patent No.: US 10,767,654 B2
(45) Date of Patent: Sep. 8, 2020

(54) SIDE-CHANNEL MACHINE (COMPRESSOR, VACUUM PUMP OR BLOWER) HAVING AN EXTRACTION DUCT IN THE STRIPPER

(71) Applicant: GARDNER DENVER DEUTSCHLAND GMBH, Bad Neustadt (DE)

(72) Inventors: Rudi Dittmar, Schmalkalden (DE); Peter Fischer, Bad Neustadt (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 98 days.

(21) Appl. No.: 15/743,296

(22) PCT Filed: Jul. 15, 2016

(86) PCT No.: PCT/EP2016/066918
§ 371 (c)(1),
(2) Date: Jan. 10, 2018

(87) PCT Pub. No.: WO2017/013021
PCT Pub. Date: Jan. 26, 2017

(65) Prior Publication Data

US 2018/0202447 A1 Jul. 19, 2018

(30) Foreign Application Priority Data

Jul. 17, 2015 (DE) ..... 10 2015 213 549

(51) Int. Cl.
*F04D 5/00* (2006.01)
*F04D 29/66* (2006.01)
(Continued)

(52) U.S. Cl.
CPC ..... *F04D 23/008* (2013.01); *F04D 5/007* (2013.01); *F04D 5/008* (2013.01); *F04D 29/161* (2013.01);
(Continued)

(58) Field of Classification Search
CPC .. F04D 15/0083; F04D 15/00; F04D 15/0005; F04D 29/66; F04D 29/665; F04D 29/682; F04D 29/701
See application file for complete search history.

(56) References Cited

U.S. PATENT DOCUMENTS 3,982,848 A * 9/1976 Schonwald ..... F04D 23/008 415/55.4
4,306,833 A * 12/1981 Sixsmith ..... F04D 5/002 415/55.3
(Continued)

FOREIGN PATENT DOCUMENTS

CN 1037566 A 11/1989
CN 1608173 A 4/2005
(Continued)

OTHER PUBLICATIONS

Basteck (DE 19708953 A1) english translation (Year: 1998).*
(Continued)

*Primary Examiner* — Woody A Lee, Jr.
*Assistant Examiner* — Brian Christopher Delrue
(74) *Attorney, Agent, or Firm* — Michael Best & Friedrich LLP

(57) ABSTRACT

The invention relates to a side-channel machine having a housing, located in the housing a side-channel for guiding a gas, and at least one gas inlet opening which is formed in the housing and is fluidically connected to the side-channel. Furthermore, the side-channel machine has at least one gas inlet pipe which connects to the at least one gas inlet
(Continued)

Figure 1:
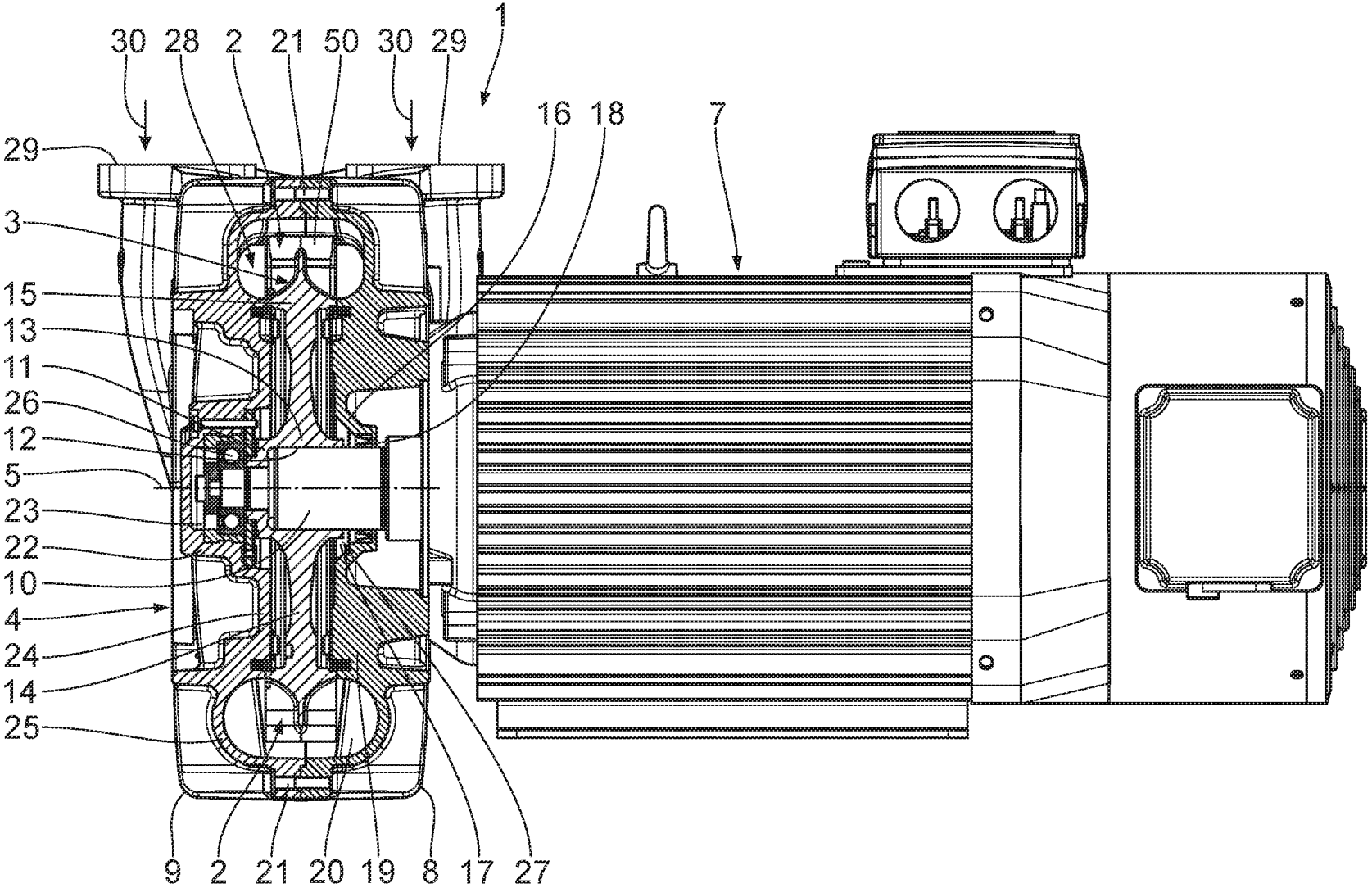

opening. The side-channel machine further comprises at least one gas outlet opening and at least one gas outlet pipe which connects to the at least one gas outlet opening. Furthermore, the side-channel machine has an impeller that can be made to rotate in the housing, with impeller blades, which bound impeller cells arranged in the side-channel, for delivering the gas in the impeller cells from the at least one gas inlet opening to the at least one gas outlet opening. The side-channel machine further has at least one interrupter arranged between the at least one gas inlet opening and the at least one gas outlet opening.

9 Claims, 6 Drawing Sheets

(51) Int. Cl.

| | |
|---|---|
| ***F04D 23/00*** | (2006.01) |
| ***F04D 29/16*** | (2006.01) |
| ***F04D 29/18*** | (2006.01) |
| ***F04D 29/40*** | (2006.01) |

(52) U.S. Cl.
CPC ..... *F04D 29/188* (2013.01); *F04D 29/403* (2013.01); *F04D 29/667* (2013.01)

(56) References Cited

U.S. PATENT DOCUMENTS

| | | | | |
|---|---|---|---|---|
| 4,749,338 | A | 6/1988 | Galtz | |
| 5,435,692 | A * | 7/1995 | Kidger | F04D 15/005 415/55.4 |
| 8,071,225 | B2 * | 12/2011 | Hehn | B22D 17/24 164/397 |
| 9,677,561 | B2 * | 6/2017 | Fischer | F04D 23/008 |
| 2005/0118013 | A1 | 6/2005 | Downham | |

FOREIGN PATENT DOCUMENTS

| | | | | |
|---|---|---|---|---|
| CN | 1754045 | A | 3/2006 | |
| CN | 101042142 | A | 9/2007 | |
| CN | 103154523 | A | 6/2013 | |
| CN | 204213044 | U | 3/2015 | |
| DE | 2409183 | A1 | 8/1975 | |
| DE | 19708953 | A1 * | 9/1998 | F04D 23/008 |
| DE | 19708953 | A1 | 9/1998 | |
| DE | 19906515 | C1 | 2/2000 | |
| DE | 10334950 | A1 * | 12/2004 | F04D 23/008 |
| DE | 10334950 | A1 | 12/2004 | |
| DE | 10334812 | A1 | 3/2005 | |
| FR | 2664333 | A1 | 1/1992 | |

OTHER PUBLICATIONS

Grohmann et al (DE 10334950 A1) english translation (Year: 2004).*

International Search Report and Written Opinion for Application No. PCT/EP2016/066918 dated Jun. 10, 2016 (9 pages).

China National Intellectual Property Administration Office Action for Application No. 201680034492.3 dated Jan. 2, 2020 (9 pages including Statement of Relevance).

China National Intellectual Property Administration Search Report for Application No. 201680034492.3 dated Jan. 2, 2020 (pp. 6 and 7 of original search report and corresponding English translation, 4 pages total).

* cited by examiner

SIDE-CHANNEL MACHINE (COMPRESSOR, VACUUM PUMP OR BLOWER) HAVING AN EXTRACTION DUCT IN THE STRIPPER

CROSS-REFERENCE TO RELATED APPLICATIONS

This is a U.S. national stage entry of International Patent Application No. PCT/EP2016/066918, filed on Jul. 15, 2016, which claims priority to German Patent Application No. 10 2015 213 549.7, filed on Jul. 17, 2015, the entire contents of all of which are fully incorporated herein by reference.

The present patent application claims the priority of the German patent application DE 10 2015 213 549.7, the contents of which are referenced herein.

The invention relates to a side-channel machine.

Side-channel machines are known in general from the prior art. Side-channel machines are capable of conveying or compressing gas.

Generic side-channel machines are known, for example, from DE 103 34 950 A1, DE 197 08 953 A1, DE 103 34 812 A1, and DE 199 06 515 C1.

The invention addresses the problem of creating a very efficient and quiet side-channel machine. Furthermore, the side-channel machine should have a very high output density.

This problem is solved in accordance with an embodiment of the invention. Geometry optimization and targeted current guidance of the side-channel machine result in improvements in at least one of the performance parameters thereof. Advantageously, the output density, efficiency and/or noise generation of the side-channel machine is improved in comparison with conventional side-channel machines. The gas that is to be conveyed is preferably air or an industrial gas. The side-channel machine is preferably designed as a side-channel blower or side channel compressor. It is advantageous if the side-channel machine is capable of functioning in a vacuum and/or compressor mode.

The side-channel machine has a single- or multi-stage design.

The at least one gas intake opening and the at least one gas discharge opening are disposed at a spacing to one another about the rotational axis in the flow direction of the gas. It is advantageous if there is an angle about the rotational axis of at least 170° between them.

The impeller is effectively connected, directly or indirectly, to a motor or drive.

The at least one interrupter is preferably mounted on the housing, or is an integral component thereof.

The at least one gas intake pipe and/or the at least one gas discharge pipe are/is preferably mounted on the housing, or an integral component thereof.

When the side-channel machine is in operation, gas is conveyed about the rotational axis in the direction of flow from the at least one gas intake opening to the at least one gas discharge opening, which is disposed downstream of the at least one gas intake opening. The gas is thus conducted in the side channel in a substantially annular manner. It is preferably pushed radially outward in the side channel by centrifugal force, and subsequently conducted back to the radially inward region of the side channel with respect to the rotational axis, where it returns to impeller cells between adjacent impeller blades, and is again subjected to the centrifugal force.

It is advantageous when there are two conveniently adjacent gas intake openings and exactly one gas discharge opening, as well as exactly one interrupter. Alternatively, there may be more than two gas intake openings, and numerous gas discharge openings, and/or interrupters.

It is useful for the side channel to have two impeller flutes. By way of example, there is exactly one gas intake pipe, which is designed to distribute, in particular in a uniform manner, the gas onto the two impeller flutes. Alternatively, one gas intake pipe is dedicated to each impeller flute.

Further advantageous designs of the invention are specified in the dependent claims.

It is advantageous when the at least one gas discharge pipe adjoins the side channel in a substantially tangential manner, in order to discharge the gas from the side channel in a substantially tangential direction. Pressure losses can be reduced through the substantially tangential arrangement of the at least one gas discharge pipe on the side channel, resulting in an improvement in the efficiency of the side-channel machine. It is advantageous when the at least one gas discharge pipe adjoins the side channel at an absolute tangent thereto, such that the gas is discharged from the side channel in a tangential direction.

Ideally, the angle over the rotational axis between an upstream connection of the at least one gas discharge pipe on the side channel and a downstream outlet of this gas discharge pipe is between 280° And 320°, preferably between 290° and 310°. This design also results in a reduction in pressure losses.

It is advantageous when the side channel is delimited by a radially outer ceiling, with respect to the rotational axis, wherein the at least one gas discharge opening adjoins the ceiling without a transition, and is substantially tangential thereto. Eddy shedding on the impeller blades and the at least one gas discharge pipe can be reduced through this design, so that curve reductions or pressure losses can be avoided. Furthermore, this can also reduce operating noises generated by the side-channel machine. It is advantageous when the at least one gas discharge pipe adjoins a ceiling that delimits the side channel radially outward in an absolutely transitionless and tangential manner.

The side channel is preferably delimited by a base on the radial interior of the rotational axis, wherein the at least one gas discharge pipe adjoins the base substantially without transition, and in a substantially tangential direction. The explanations regarding the radially outer ceiling apply in a substantially analogous manner to another embodiment. It is advantageous when the at least one gas discharge pipe adjoins a base that delimits the side channel radially inward without a transition and tangentially.

It is useful when a flow cross section in the at least one gas discharge pipe expands, at least in part, in the flow direction of the gas, wherein opposing flow guidance walls of the at least one gas discharge pipe preferably assume an expansion angle of no more than 11°, preferably no more than 9° in relation to one another in at least one upstream starting region of the at least one gas discharge pipe.

It is advantageous when the at least one gas discharge pipe has at least one, preferably radial inner wall with respect to the rotational axis, which runs substantially parallel to an absolute speed vector of the gas flow in the side channel, adjacent at the downstream side to the at least one interrupter. Noises caused by the gas striking the at least one interrupter can be prevented with this side-channel machine, ensuring that the side-channel machine can be operated with a particularly low noise generation. The gas thus flows conveniently along the at least one wall of the at least one gas discharge pipe. It is advantageous when this at least one wall is present on the at least one interrupter. It is useful when the at least one wall runs absolutely parallel to an absolute speed vector of the gas flowing in the side channel adjacent to the at least one interrupter on the upstream side.

With the side-channel machine according to another embodiment, an interrupter-gas mass flow can be removed without damage into the at least one gas discharge pipe. The at least one outlet channel ideally has a circular cross section, and preferably runs in a radial direction with respect to the rotational axis. In particular, it is straight.

Another embodiment prevents gas from flowing unintentionally back from the at least one gas discharge pipe into the side channel or the at least one interrupter, which would have a negative impact on the efficiency and noise generation. It is advantageous when the at least one valve is disposed on the at least one interrupter, substantially on the discharge side with respect to the gas flow.

With another embodiment, the gas can be vacuumed off in a simple manner from at least one of the impeller cells adjacent to the at least one outlet channel. It is advantageous when the cross section constriction necessary for forming the Venturi assembly is located in the at least one gas discharge pipe.

With another embodiment, the gas can be reliably vacuumed off in a simple manner from at least one of the impeller cells adjacent to the at least one outlet channel.

With another embodiment, the gas can be reliably vacuumed off in a simple manner from at least one of the impeller cells adjacent to the at least one outlet channel.

Impairments to the vacuuming of the gas in the at least one vacuum channel can be prevented through the spacing between the downstream intake opening of the at least one vacuum channel in the side channel and an upstream start of the at least one vacuum channel in another embodiment.

According to another embodiment, at least one relief groove is disposed in the at least one interrupter, starting from the side channel. The relief noise of the gas that is caused when the side channel is operating by the excited interrupter-gas mass flow escaping from the impeller cells can be reduced by the at least one relief groove. Furthermore, useable volume flows can be reduced by blocking an intake cross section.

Effects of the cell relief in the at least one gas intake pipe can be prevented through another embodiment, such that the useful vacuum volume flow remains unaffected.

Another embodiment effectively prevents the generation of noises and turbulences.

Pressure losses can be reduced through the substantially tangential arrangement of the at least one gas intake pipe on the side channel in accordance with another embodiment, resulting in an improvement in the efficiency of the side-channel machine. It is advantageous when the at least one gas intake pipe adjoins the side channel at an absolute tangent for a tangential introduction of the gas into the side channel.

Figure 2:
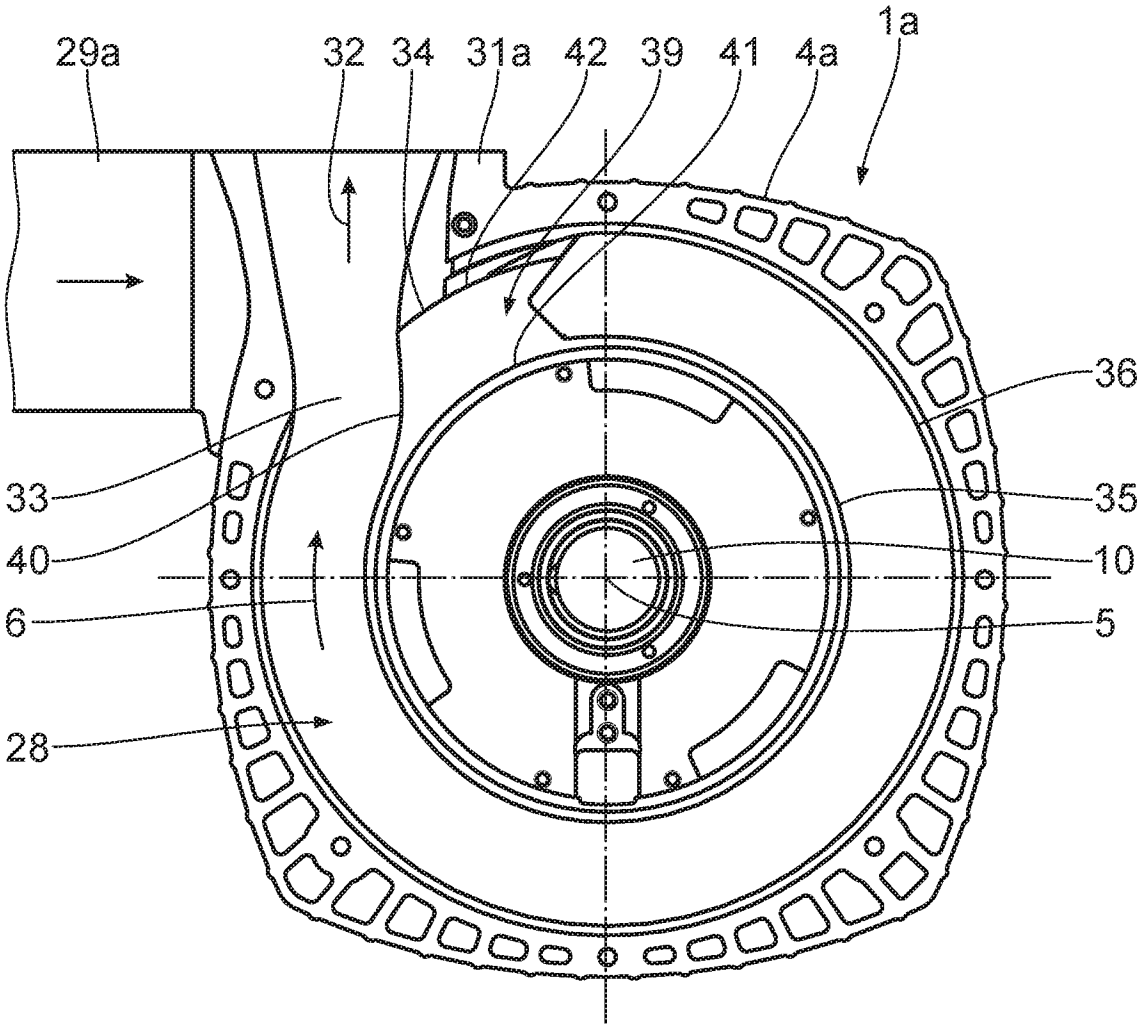
Figure 3:
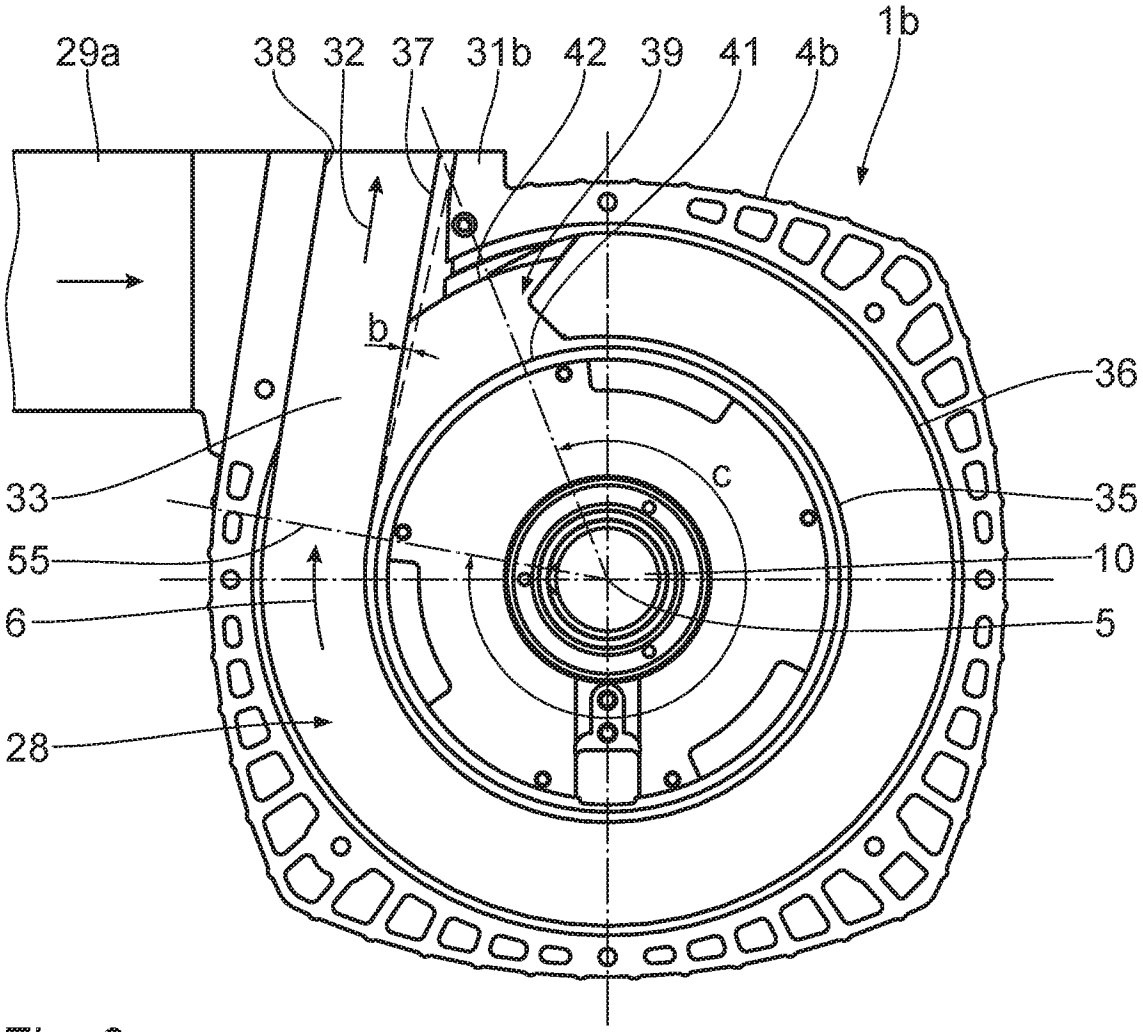
Figure 4:
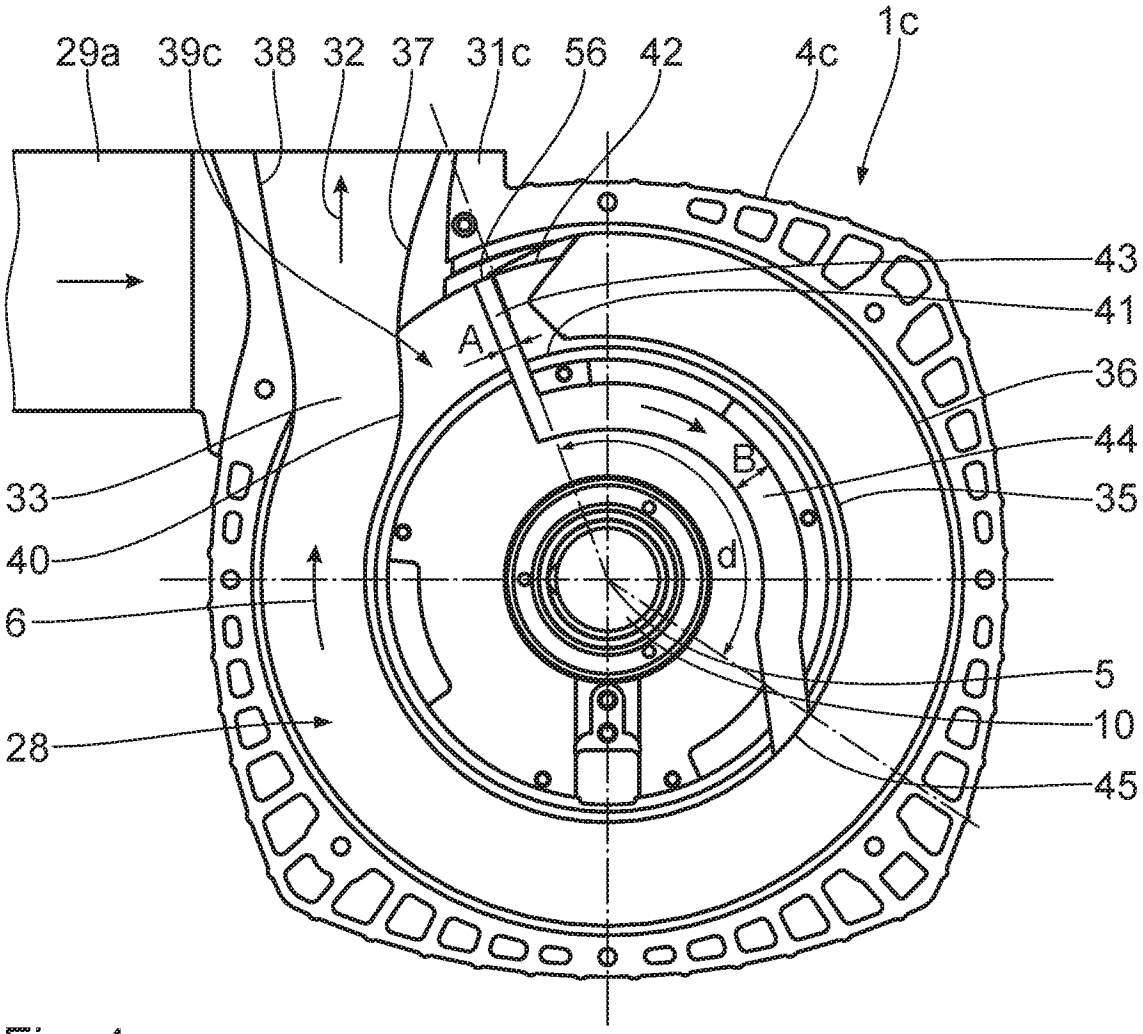
Figure 5:
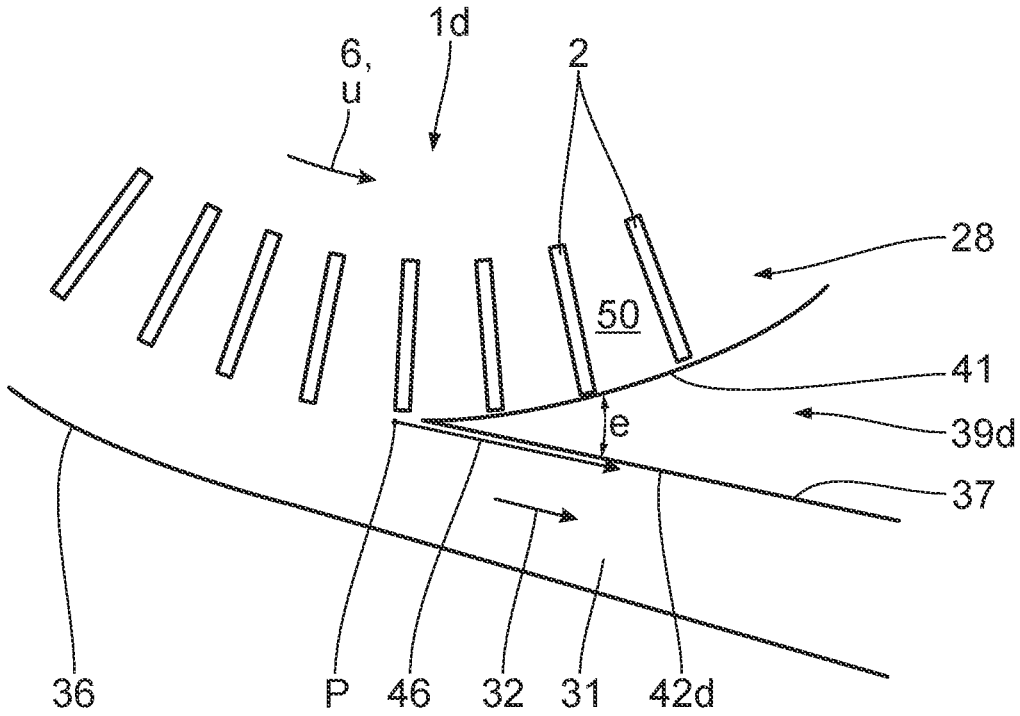
Figure 6:
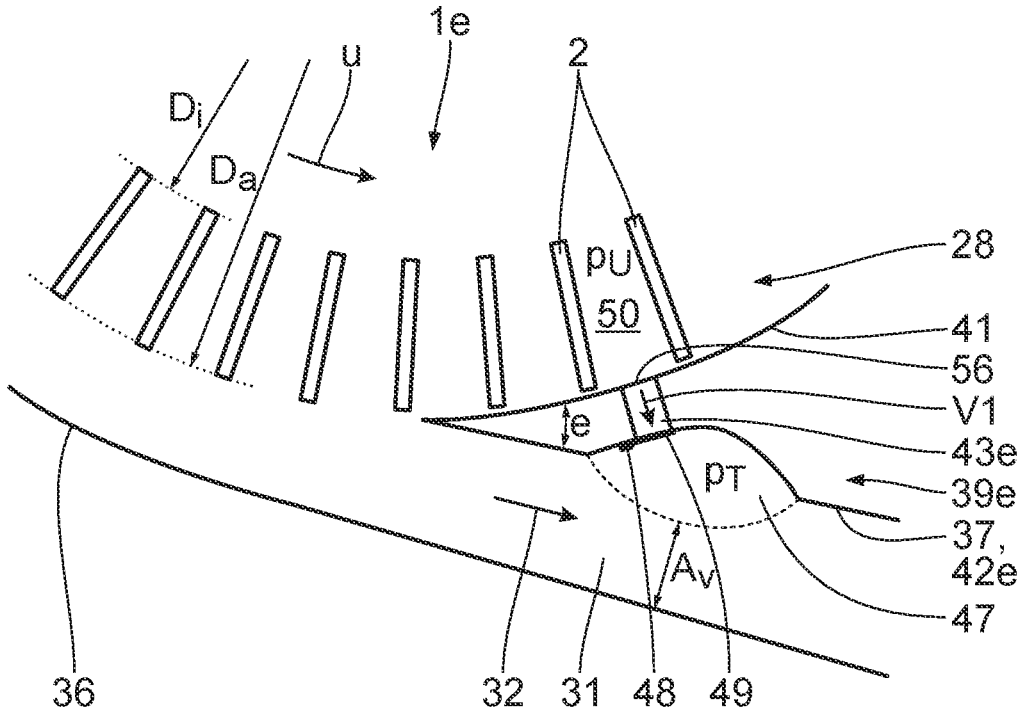
Figure 7:
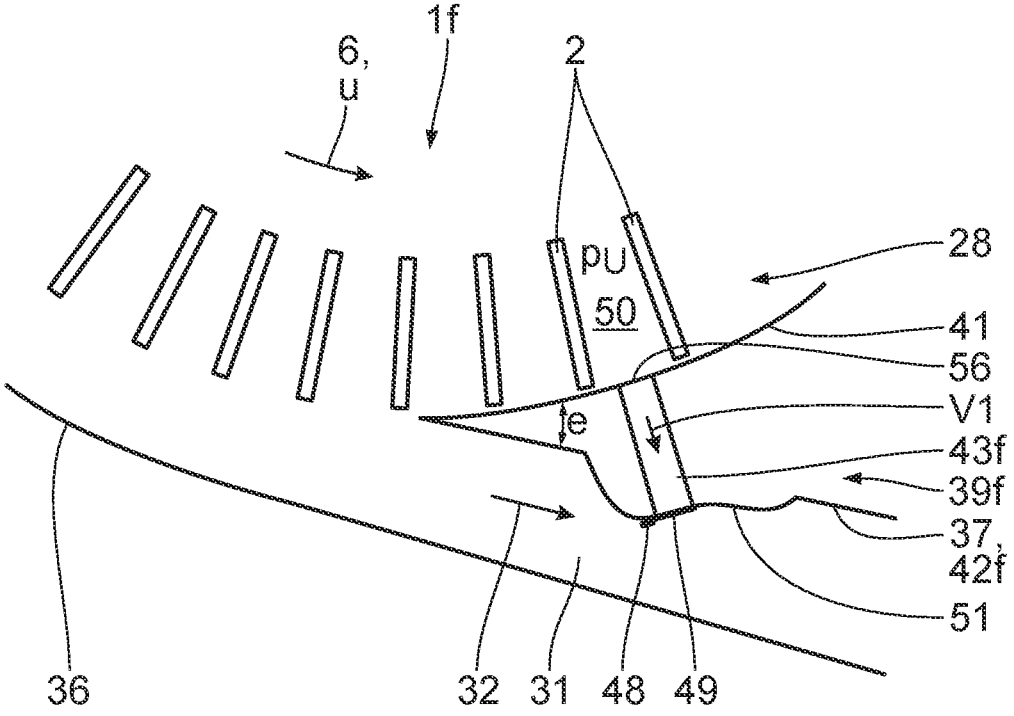
Figure 8:
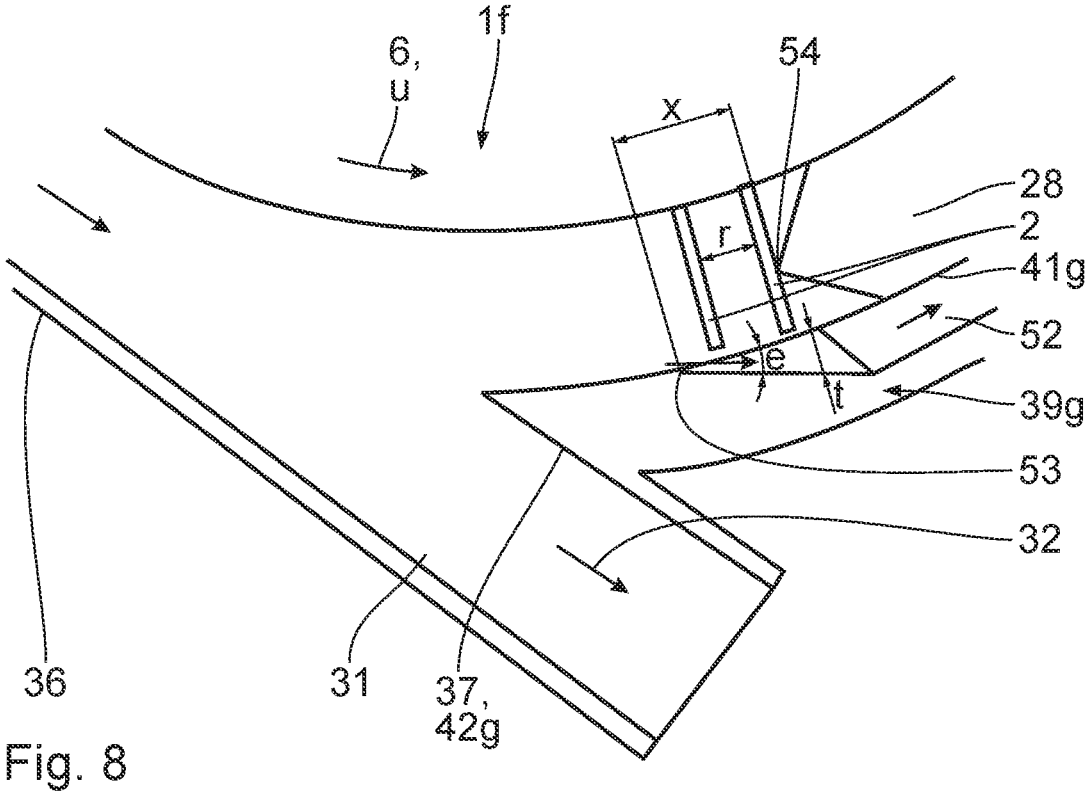

Preferred embodiments of the invention shall be described below in an exemplary manner with reference to the attached drawings. Therein:

FIG. 1 shows an illustration of a conventional side-channel machine and a flange-mounted drive, wherein the side-channel machine is shown in a longitudinal section, FIG. 2 shows a top view of a side-channel machine according to the invention in accordance with a first embodiment, FIG. 3 shows a top view corresponding to FIG. 2, of a side-channel machine according to the invention in accordance with a second embodiment, FIG. 4 shows a top view corresponding to FIG. 2, of a side-channel machine according to the invention in accordance with a third embodiment, FIG. 5 shows a simplified illustration, substantially showing a gas discharge pipe, a part of an impeller, and a part of an interrupter of a side-channel machine according to the invention in accordance with a fourth embodiment, FIG. 6 shows a simplified illustration corresponding to FIG. 5, substantially showing a gas discharge pipe, a part of an impeller, and a part of an interrupter of a side-channel machine according to the invention in accordance with a fifth embodiment, FIG. 7 shows a simplified illustration corresponding to FIG. 5, substantially showing a gas discharge pipe, a part of an impeller, and a part of an interrupter of a side-channel machine according to the invention in accordance with a sixth embodiment, and FIG. 8 shows a simplified illustration corresponding to FIG. 5, substantially showing a gas discharge pipe, a part of an impeller, and a part of an interrupter of a side-channel machine according to the invention in accordance with a seventh embodiment.

First, in reference to FIG. 1, for the purpose of a general explanation, a conventional side-channel blower 1 comprises an impeller 3 with impeller blades 2, which is mounted in a housing 4 such that it can rotate about a longitudinal central axis, or rotational axis 5. A conventional drive 7 rotates the impeller 3. The gas is conveyed in this manner into the housing 4.

The housing 4 comprises a first housing part 8 and a second housing part 9. The first housing part 8 and the second housing part 9 are joined as shown in FIG. 1, and collectively encompass the impeller 3, with the impeller blades 2, which is mounted in a rotationally fixed manner on a drive shaft 10 such that it rotates therewith.

The impeller has a disk-like design. It comprises an inner impeller hub 11 with a central, circular hub bore 12. The impeller hub 11 is formed by an inner hub foot 13, which delimits the hub bore 12 radially toward the outside, and a radial, circular hub disk 14 adjoined thereto. Furthermore, the impeller 3 comprises a radial outer carrier ring 15, which adjoins the hub disk 18 on the outside, and overlaps it on both sides toward the longitudinal central axis 5. The carrier ring 15 has a number of impeller blades 2 distributed over its circumference, which extend radially away from the carrier ring 15. In particular, the impeller blades 2 are equidistant to one another. Impeller cells 50 are delimited by the impeller blades 2 in the direction of the circumference.

The drive shaft 10 is accommodated in the central hub bore 12. A conventional fitted key connection is provided between the drive shaft 10 and the hub foot 13 for transferring a torque applied by the drive shaft 10 to the impeller hub 11 in order to rotate the impeller 3.

The first housing part 8 has a central hub section 16, which radially and axially delimits a partial hub receiving space 17. A central shaft bore 18 passes through the hub section 16, opening into the partial hub receiving space 17. An annular side wall 19 adjoins the hub section 16, which extends radially outward from the hub section 16. A circumferential channel section 20 borders the outside of the side wall 19. The hub section 16, the side wall 19, and the channel section 20 are integrally formed as a molded unit, and form the first housing part 8.

The second housing part 9, which is screwed to the first housing part 8 with numerous fastener screws 21 also has a central hub section 22, which radially and axially delimits the partial hub receiving space 23. An annular side wall 24 adjoins the hub section 22, running radially outward. A circumferential channel section 25 is connected to the outside of the side wall 24. A roller bearing 26 for the drive shaft 10 is disposed in the hub section 22. The hub section 22, the side wall 24 and the channel section 25 are integrally formed as a molded unit, and collectively form the second housing part 9.

The first housing part 8 and the second housing part 9 are connected to one another in the assembled state such that the two partial hub receiving spaces 17, 23 collectively delimit a hub receiving space 27, and the two channel sections 20, 25 collectively delimit a side channel 28 for conveying the gas. The two side walls 19, 24 are parallel to one another. The side channel 28 extends in an annular manner about the longitudinal central axis 5.

For practical purposes, the second housing part 9 forms a housing cover that can be removed from the first housing part 8. Alternatively, the reverse is also possible.

The side-channel blower 1 has two gas intake pipes 29. There is a gas intake pipe 29 on each housing part 8, 9. Each gas intake pipe 29 supplies a flute in the side channel 28. The gas that is to be conveyed in a flow direction 30 into the side-channel blower 1 can be introduced via the gas intake pipes 29 when the side-channel blower 1 is in operation.

Furthermore, the side-channel blower 1 has a gas discharge pipe (not shown), formed by the two housing parts 8, 9. There is a flow connection between the gas discharge pipe and the side channel 28. The gas can be removed from the side-channel blower 1 in a flow direction 32 via the gas discharge pipe. The gas intake pipes 29 and the gas discharge pipe are substantially perpendicular to one another.

The hub foot 13 of the impeller 3 is disposed in the hub receiving space 27 that is delimited by the hub sections 16, 22 when the side-channel blower 1 is assembled, wherein the drive shaft 10 passes through the hub bore 12. The hub disk 14 of the impeller 3 extends radially outward from the hub foot 13 between the spaced apart side walls 18, 24 of the housing 4. The carrier ring 15 and the impeller blades 2 are located in the circumferential side channel 28 thereby.

A first embodiment of the invention shall be explained below with reference to FIG. 2, with regard to how the subsequent embodiments can be used in the side-channel blower 1 depicted in FIG. 1. Reference shall be made to the explanations regarding the side-channel blower 1 depicted in FIG. 1. Identical components shall be labeled with the same reference symbols as those used with the side-channel blower 1 depicted in FIG. 1. Functionally identical, but structurally different components are labeled with the same reference symbol, followed by an "a."

The side channel 28 in the side-channel blower 1 is spatially delimited, radially inward by a base 35, and radially outward by a ceiling 36, with respect to the longitudinal central axis 5. The base 35 and the ceiling 36 are opposite one another and spaced apart, such that they delimit the side channel 28. They are formed on the housing 4*a*.

A gas discharge pipe 31*a* is connected to the side channel 28, substantially tangential thereto, in the side-channel blower 1*a* in accordance with FIG. 2, such that gas conveyed in a conveyor 6 exits the side channel 28 via a gas discharge opening 33 in the housing in a substantially tangential direction. There is a gas deflection point between the side channel 28 and the gas discharge pipe 31*a*, adjacent to the gas discharge opening 33, with which the gas that has been conveyed is deflected slightly radially outward with respect to the longitudinal central axis 5. The conveyed gas is deflected slightly thereby in both the region of the base 35 as well as in the region of the ceiling 36.

The gas discharge pipe 31*a* expands substantially evenly in the flow direction 32 of the gas.

As can also be derived from FIG. 2, the at least one gas intake pipe 29*a* is connected to the side channel 28 substantially tangential thereto, such that the gas is conveyed into the side channel 28 in a substantially tangential direction via at least one gas intake opening 34 in the housing 4*a*.

Pressure losses in the side-channel blower 1*a* can be effectively reduced by the substantially tangential arrangement of the pipes 29*a*, 21*a* on the side channel 28.

An interrupter 29 is disposed in the side channel 28 between the gas discharge opening 33 and the at least one gas intake opening 34. The interrupter 39 has a side wall 40 adjacent to the gas discharge opening 33. Furthermore, the interrupter 39 has a radial inner wall 41, and a radial outer wall 42 opposite the inner wall 41, with respect to the longitudinal central axis 5.

A second embodiment of the invention shall be described below with reference to FIG. 3. Structurally identical components have the same reference symbols as those in the side-channel blowers 1, la depicted in FIGS. 1 and 2, respectively. Functionally identical, but structurally different components have the same reference symbols, followed by a "b."

With the side-channel blower 1*b*, the at least one gas discharge pipe 29*a* again adjoins the side channel 28, substantially tangential thereto.

The gas discharge pipe 21*b* adjoins the side channel 28 at an absolute or full tangent. In accordance with FIG. 3, the connection between the side channel 28 and the gas discharge pipe 21*b* forms a smooth transition. This applies to both the radially inner as well as the radially outer guidance of the gas with respect to the longitudinal central axis 5.

It is advantageous when the gas discharge pipe 31*a* expands downstream of the gas discharge opening 33. It is particularly preferred that an inner flow guidance wall 37 of the gas discharge pipe 31*b* adjoining the base 35 deviates by an angle b from the parallel to an opposite outer flow guidance wall 38 of the gas discharge pipe 31*b*, as is indicated by a broken line in FIG. 3. The angle b is no more than 9°.

For practical purposes, there is a connection angle c, lying between 290° and 310° in relation to the longitudinal central axis 5, between a connection 55 of the gas discharge pipe 31*b* to the side channel 28 and the radially inner flow guidance wall 37 at the discharge of the side-channel blower 1*b*.

A third embodiment of the invention shall be described below in reference to FIG. 4. Identical parts are labeled with the same reference symbols as those in the preceding embodiments. Structurally different but functionally identical parts have the same reference symbols, followed by a "c."

In the side-channel blower 1*c* depicted in FIG. 4, a outlet channel 43 passes through the interrupter 39*c*, which extends radially between the inner wall 41 of the interrupter 39*c* and the outer wall 42 of the interrupter with respect to the longitudinal central axis 5. The outlet channel 43 has a cross section area A.

A vacuum channel 44 adjoins the outlet channel 43 on the downstream side, at the radial interior thereof, which opens into the side channel 28 at a spacing to the outlet channel 43. The point of entry, or entry opening 45 of the vacuum channel 44 in the side channel 28 is located basically opposite the outlet channel 43. The entry opening 45 is spaced apart from the outlet channel 43 at an angle d over the longitudinal central axis 5 lying between 120° and 140°.

The vacuum channel 44 has a larger, in particular substantially larger, cross section area B than the outlet channel 43.

Gas is vacuumed via the outlet channel 43 out of an impeller cell 50 of the rotating impeller 3 that is currently adjacent to an intake opening of the outlet channel 43 opening into the side channel 28. The gas is conveyed, e.g. through pressure differences, in particular between the intake opening 56 and the entry opening 45. In particular, the pressure at the entry opening 45 is lower than at the intake opening 56. The impeller cells 50 are spatially delimited in the circumferential direction of the side channel 28 by adjacent impeller blades 2. The gas then flows into the vacuum channel 44 and re-enters the side channel 28 via the entry opening 45.

A fourth embodiment of the invention shall be described below with reference to FIG. 5. Identical parts are labeled with the same reference symbols as in the preceding embodiments. Structurally different but functionally identical parts are labeled with the same reference symbols, followed by a "d."

In the side-channel blower 1*d* depicted in FIG. 5, the outer wall 42*d* of the interrupter 39*d*, which also forms the flow guidance wall 37, extends parallel to an absolute speed vector, or absolute speed direction 46, of the gas flowing directly upstream of the interrupter at the flow point P. The absolute speed vector 46 is obtained by adding the circumferential speed of the impeller 3 about the longitudinal central axis 5 and the relative speed of the gas moving radially outward in relation to the longitudinal central axis 5.

The inner wall 41 and the outer wall 42 form an angle e of preferably between 15° and 40°, more preferably between 20° and 30°.

The gas discharge pipe 31 can expand in the direction of flow 32.

A fifth embodiment of the invention shall be explained below with reference to FIG. 6. Identical parts are labeled with the same reference symbols as in the preceding embodiments. Structurally different but functionally identical parts are labeled with the same reference symbols, followed by an "e."

In contrast to the embodiment depicted in FIG. 5, the outlet channel 43*e* is located in the interrupter 39*e* in the side-channel blower 1*e*, forming a flow connection between the side channel 28 and the gas discharge pipe 31. The outlet channel 43*e* extends radially, or substantially radially, with respect to the longitudinal central axis 5.

For a reliable vacuum, the following applies in particular: $p_U > p_T$, wherein $p_U$ is the pressure prevailing in the impeller cell 50 at the outlet channel 43*e*, and $p_T$ is the pressure prevailing downstream of the outlet channel 43*e* in the gas discharge pipe 31.

A removal of the gas via the outlet channel 43*e* from the side channel 28 to the gas discharge pipe 31 is particularly reliable when the following condition is also fulfilled:

$$V_1 > u \cdot A_K \cdot \sqrt{\frac{p_2}{p_1} \cdot \left(1 - \left(\frac{D_i}{D_a}\right)^2\right)}$$

$V_1$: suction volume flow or vacuum volume flow in the outlet channel 43*e* u: circumferential speed of the impeller $A_K$: cross section area of the side channel 28 on the pressure side $p_2/p_1$: pressure ratio over the side-channel blower 1*e*

$D_i$: diameter of the impeller at the base of the impeller blade $D_a$: outer diameter of the impeller The suction volume flow is therefore dependent on the circumferential speed of the impeller, the cross section area of the side channel on the pressure side, the pressure ratio over the side-channel blower, and the diameter of the impeller at the base of the impeller blade, and the outer diameter of the impeller.

A dead space hollow 47 extends from the gas discharge pipe 31 or the outer wall 42*e* of the interrupter 39*e* in accordance with a preferred embodiment. The outlet channel 43*e* opens into the dead space hollow 47.

A self-actuating valve plate 49 is attached to the interrupter 39*e* in the dead space hollow 47 via at least one attachment means 48, which closes the outlet channel 43*e* at the downstream end region thereof with respect to its intake opening 56 when it is in its closed position. In the open position, the valve plate 49 is lifted at least in part away from the interrupter 39*e*, and thus at least partially opens the outlet channel 43*e* to the gas.

The gas discharge pipe 31 thus has an expanded cross section area in the region of the dead space hollow 47. A gas dead space region is formed in the dead space hollow 47 when the side-channel blower 1*e* is in operation. There is thus a reduced gas pressure in the dead space hollow 47, such that gas is suctioned out of the impeller cell 50 that is currently adjacent to the outlet channel 43*e* when the valve plate 49 is open. When it is closed, valve plate 49 prevents an unintentional backflow of the gas from the gas discharge pipe 31, or the dead space hollow 47, into the outlet channel 43*e*, or the side channel 28, respectively.

Alternatively, a design without a valve plate 49 is also possible. The valve plate 49 can also be present in the design depicted in FIG. 6 if there is no dead space hollow 47.

A removal of the gas via the outlet channel 43*e* from the side channel 28 to the gas discharge pipe 31 is particularly reliable when the following condition is fulfilled:

$$V_1 > u \cdot A_K \cdot \sqrt{\frac{p_2}{p_1} \cdot \frac{1 - \left(\frac{D_i}{D_a}\right)^2}{\left(\frac{A_K}{A_V}\right)^2 - 1}}$$

$A_v$: cross section area of the vena contracta of the Venturi nozzle in the gas discharge pipe 31

The suction volume flow is thus dependent on the circumferential speed of the impeller, the cross section area of the side channel at the pressure side, the pressure ratio over the side-channel blower, the diameter of the impeller at the base of the impeller blade, and the outer diameter of the impeller, as well as the cross section area of the vena contracta of the Venturi nozzle in the gas discharge pipe.

A sixth embodiment of the invention shall be described below with reference to FIG. 7. Identical parts are labeled with the same reference symbols as in the preceding embodiments. Structurally different but functionally identical parts are labeled with the same reference symbols, followed by an "f."

The side-channel blower 1*f* has a flow-reducing projection 51, instead of the dead space hollow 47 on the interrupter 39*f*, which extends into the gas discharge pipe 31. The outlet channel 43*f* also passes through flow-reducing projection 51. A valve plate 49 is preferably again attached to the flow-reducing projection 51 via at least one attachment means 48.

The gas discharge pipe 31 has a reduced flow cross section in the region of the flow reduction projection 51, such that the gas is conveyed there at a particularly high flow speed. Conversely, this results in a reduced pressure there, such that gas from the impeller cell 50 currently adjacent to the outlet channel 43*f* is vacuumed into the gas discharge pipe 31 via the outlet channel 43*f*. In this manner, a Venturi nozzle, or assembly, is basically created.

A seventh embodiment of the invention shall be described below with reference to FIG. 8. Identical parts are labeled with the same reference symbols as in the preceding embodiments. Structurally different but functionally identical parts are labeled with the same reference symbols, followed by a "g."

There is at least one relief groove 52 in the interrupter 39*g*, starting from the side channel 28. There is preferably a spacing x between an upstream starting point 53 of the relief groove 52 and an axial or circumferential impeller cell opening 54, which is at least 1.5 times the spacing r between adjacent impeller blades 2 over the longitudinal central axis 5. The radial depth t of the relief groove 52 increases gradually in relation to the longitudinal central axis in the direction of conveyance. The angle e of the relief groove 52 is advantageously in correlation with the pressure ratio $p_2/p_1$ and the circumferential speed u of the impeller, wherein $p_2$ is the prevailing pressure in the impeller cells 50, and $p_1$ is the vacuum pressure of the side-channel blower. When the impeller cells 50 are relieved, the circumferential speed of the impeller 3 and the flow speed overlap, such that translatory or even supersonic flows may also occur. An estimation of the occurrences of supersonic flows is obtained from the following equation:

$$M \cdot u_{krit} = 0.9 \cdot \left(\frac{p_1}{p_2}\right)^{2.46}$$

Supersonic flows occur when $M*u>M*u_{krit}$. The at least one relief groove 52 can then be dimensioned according to the known laws of the "Prandtl-Meyer" function.

It is possible to combine the different embodiments, in particular with respect to the different pipes and interrupters.

What is claimed is:

1. A side-channel machine comprising:

a) a housing;

b) a substantially annular side channel located in the housing for conducting a gas;

c) at least one gas intake pipe;

d) at least one gas intake opening formed in the housing, that has a flow connection to the side channel for conducting the gas from the at least one gas intake pipe into the side channel;

e) at least one gas discharge opening disposed in the housing for removing the gas from the side channel;

f) at least one gas discharge pipe adjoining the at least one gas discharge opening;

g) an impeller that can rotate in the housing about a rotational axis that has impeller blades that delimit impeller cells disposed in the side channel for conveying the gas located in the impeller cells in the side channel from the at least one gas intake opening to the at least one gas discharge opening;

h) at least one interrupter disposed between the at least one gas intake opening and the at least one gas discharge opening to prevent the gas from being transported from the at least one gas discharge opening to the at least one gas intake opening, i) at least one outlet channel disposed in the at least one interrupter for removing the gas enclosed in at least one of the impeller cells currently adjacent to the at least one outlet channel from the side channel into at least one gas discharge pipe;

j) at least one Venturi assembly for vacuuming the gas enclosed in at least one of the impeller cells currently adjacent to the at least one outlet channel out of the side channel into the at least one gas discharge pipe via the at least one outlet channel; and (k) at least one plate valve dedicated to the at least one outlet channel, for preventing a backflow of the gas from the at least one gas discharge pipe into the side channel.

2. The side-channel machine according claim 1, characterized by at least one dead space hollow disposed on the interrupter for vacuuming the gas enclosed in at least one of the impeller cells currently adjacent to the at least one outlet channel into the at least one gas discharge opening via the at least one outlet channel.

3. The side-channel machine according to claim 1, characterized by at least one vacuum channel adjoining the at least one outlet channel for vacuuming the gas enclosed in at least one of the impeller cells currently adjacent to the at least one outlet channel out of the side channel into the at least one outlet channel at a spacing to the side channel.

4. The side-channel machine according to claim 3, characterized in that an overall cross section area of the at least one outlet channel lies between 0.001× the overall volume of the impeller cells of the impeller and 0.006× the overall volume of the impeller cells of the impeller.

5. The side-channel machine according to claim 4, characterized in that there is an angle over the rotational axis between a downstream entry opening of the at least one vacuum channel in the side channel and an upstream start of the at least one vacuum channel, in a range of 90° to 170°.

6. The side-channel machine according to claim 1, characterized in that at least one relief groove is disposed in the at least one interrupter, starting from the side channel.

7. The side-channel machine according to claim 6, characterized in that there is a minimum spacing between an upstream start of the at least one relief groove and an impeller cell opening of at least one of the impeller cells adjacent to the at least one relief groove that is 1.1 times to 2.0 times the spacing of adjacent impeller blades in the circumferential direction over the rotational axis.

8. The side-channel machine according to claim 6, characterized in that the at least one relief groove is shaped such that the gas is capable of flowing along at least a portion of the wall of the interrupter delimiting the at least one relief groove.

9. The side-channel machine according to claim 1, characterized in that the at least one gas intake pipe adjoins the side channel substantially at a tangent thereto for a substantially tangential introduction of the gas into the side channel.

* * * * *